US007281517B2

(12) United States Patent
Miyazaki et al.

(10) Patent No.: US 7,281,517 B2
(45) Date of Patent: Oct. 16, 2007

(54) INTERNAL COMBUSTION ENGINE PROVIDED WITH DOUBLE SYSTEM OF FUEL INJECTION

(75) Inventors: Kazuma Miyazaki, Toyota (JP); Mitsuto Sakai, Toyota (JP); Yutaka Iwami, Iwata (JP); Masato Nishigaki, Iwata (JP); Yukio Shimojikkoku, Iwata (JP)

(73) Assignees: Yamaha Hatsudoki Kabushiki Kaisha, Shizuoka-ken (JP); Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/378,922

(22) Filed: Mar. 17, 2006

(65) Prior Publication Data

US 2006/0207568 A1 Sep. 21, 2006

(30) Foreign Application Priority Data

Mar. 18, 2005 (JP) ..... 2005-080697

(51) Int. Cl.
*F02D 41/30* (2006.01)
*F02M 69/54* (2006.01)

(52) U.S. Cl. ..... 123/431; 123/446; 123/458

(58) Field of Classification Search ..... 123/431, 123/446, 457, 458
See application file for complete search history.

(56) References Cited

U.S. PATENT DOCUMENTS 3,998,614 A 12/1976 Schonberger et al.
4,257,375 A 3/1981 Ulrich
4,373,491 A 2/1983 Knapp
4,526,152 A 7/1985 Hideg et al.
4,694,808 A 9/1987 Peters
4,926,821 A 5/1990 Porth et al.
5,094,210 A 3/1992 Endres et al.
5,251,582 A 10/1993 Mochizuki
5,265,562 A 11/1993 Kruse
5,460,128 A 10/1995 Kruse
5,566,650 A 10/1996 Kruse
5,608,632 A 3/1997 White
5,694,902 A 12/1997 Miwa et al.
5,894,832 A 4/1999 Nogi et al.
5,924,405 A 7/1999 Hashimoto (Continued)

FOREIGN PATENT DOCUMENTS

DE 37 07 805 9/1987

(Continued)

*Primary Examiner*—T. M. Argenbright
(74) *Attorney, Agent, or Firm*—Knobbe Martens Olson & Bear LLP

(57) ABSTRACT

A double system of fuel injection type internal combustion engine includes: a direct injection injector and a port fuel injection injector; a control unit for changing a fuel injection distribution ratio of fuels injected from these injectors; a delivery pipe for the direct injection injector; a high pressure fuel pump; a fuel pressure sensor and a fuel temperature sensor for detecting a fuel pressure and a fuel temperature in the delivery pipe; and a fuel regulating unit for regulating the fuel pressure and fuel temperature in the delivery pipe. The control unit can control the fuel regulating unit so as to lower the exceeding value thereof when the fuel injection distribution ratio of the port fuel injection injector is higher than that of the direct injection injector and at least one of the fuel pressure value and fuel temperature value exceeds an aimed value.

5 Claims, 6 Drawing Sheets

U.S. PATENT DOCUMENTS

| | | | | |
|---|---|---|---|---|
| 6,024,064 | A | 2/2000 | Kato et al. | |
| 6,039,029 | A | 3/2000 | Nagasaka et al. | |
| 6,058,904 | A | 5/2000 | Kruse | |
| 6,192,857 | B1 | 2/2001 | Shimada | |
| 6,340,014 | B1 | 1/2002 | Tomita et al. | |
| 6,405,704 | B2 | 6/2002 | Kruse | |
| 6,467,465 | B1 | 10/2002 | Lorts | |
| 6,539,923 | B1 | 4/2003 | Mengoli | |
| 6,637,406 | B2 | 10/2003 | Yamada et al. | |
| 6,662,777 | B2 | 12/2003 | Tsuchiya | |
| 6,827,064 | B2 | 12/2004 | Akagi et al. | |
| 6,843,219 | B2 | 1/2005 | Matsuda et al. | |
| 6,959,693 | B2 | 11/2005 | Oda | |
| 6,961,651 | B2 | 11/2005 | Oshima | |
| 7,013,874 | B2 | 3/2006 | Kurayoshi et al. | |
| 7,063,070 | B2 | 6/2006 | Mashiki | |
| 7,082,927 | B2 * | 8/2006 | Miyashita | 123/431 |
| 7,121,261 | B2 * | 10/2006 | Kinose | 123/431 |
| 2001/0027776 | A1 * | 10/2001 | Amou et al. | 123/478 |
| 2001/0047794 | A1 | 12/2001 | Kato | |
| 2004/0007209 | A1 | 1/2004 | Ohtani | |
| 2005/0205067 | A1 | 9/2005 | Koide et al. | |
| 2006/0207527 | A1 * | 9/2006 | Saeki et al. | 123/431 |
| 2006/0207555 | A1 * | 9/2006 | Ito et al. | 123/406.47 |
| 2006/0207567 | A1 * | 9/2006 | Yamaguchi et al. | 123/431 |
| 2006/0212208 | A1 * | 9/2006 | Uchida et al. | 701/104 |

FOREIGN PATENT DOCUMENTS

| | | | |
|---|---|---|---|
| EP | 0 169 481 | A | 1/1986 |
| EP | 1030048 | A2 | 8/2000 |
| EP | 1 096 138 | A2 | 5/2001 |
| EP | 1 096 138 | A3 | 5/2001 |
| EP | 1 293 653 | | 3/2003 |
| EP | 1 387 081 | A2 | 2/2004 |
| EP | 1 396 633 | A2 | 3/2004 |
| EP | 1 533 518 | A1 | 5/2005 |
| GB | 2 009 843 | A | 10/2001 |
| JP | 49-081719 | | 8/1974 |
| JP | 63-098479 | | 6/1988 |
| JP | 63-138119 | | 6/1988 |
| JP | 01-240765 | | 9/1989 |
| JP | 03-015622 | | 1/1991 |
| JP | 03-275978 | | 12/1991 |
| JP | 4-94434 | | 3/1992 |
| JP | 7-247924 | | 9/1995 |
| JP | 7-269394 | | 10/1995 |
| JP | 7-332208 | | 12/1995 |
| JP | 8-109861 | | 4/1996 |
| JP | 8-121285 | | 5/1996 |
| JP | 8-144889 | | 6/1996 |
| JP | 09-203357 | | 8/1997 |
| JP | 10-054318 | | 2/1998 |
| JP | 10-115270 | | 5/1998 |
| JP | 10-141194 | | 5/1998 |
| JP | 10-227239 | | 8/1998 |
| JP | 11-082250 | | 3/1999 |
| JP | 11-132076 | | 5/1999 |
| JP | 11-159424 | | 6/1999 |
| JP | 11-315733 | | 11/1999 |
| JP | 11-324765 | | 11/1999 |
| JP | 11-350966 | | 12/1999 |
| JP | 2000-97131 | | 4/2000 |
| JP | 2000-97132 | | 4/2000 |
| JP | 2000-130234 | | 5/2000 |
| JP | 2000-240494 | | 9/2000 |
| JP | 2001-115919 | | 4/2001 |
| JP | 2001-164961 | | 6/2001 |
| JP | 2001-248478 | | 9/2001 |
| JP | 2002-047973 | | 2/2002 |
| JP | 2002-048035 | | 2/2002 |
| JP | 2002-195141 | | 7/2002 |
| JP | 2002-317738 | | 10/2002 |
| JP | 2004-027911 | | 1/2004 |
| JP | 2004-270531 | | 9/2004 |
| JP | 2004-308510 | | 11/2004 |
| JP | 2006-57594 | | 3/2006 |
| WO | WO 01/79690 | A1 | 10/2001 |

* cited by examiner

INTERNAL COMBUSTION ENGINE PROVIDED WITH DOUBLE SYSTEM OF FUEL INJECTION

CROSS REFERENCE TO RELATED APPLICATION

This application is based upon and claims the benefit of priority from prior Japanese Patent Application No. 2005-080697 filed on Mar. 18, 2005, the entire contents of which are incorporated herein by reference.

BACKGROUND OF THE INVENTION

1. Field of the Invention

The present invention relates to an internal combustion engine provided with double system of fuel injection including a direct injection (DI) system and a port fuel injection (PFI) system.

2. Related Art

In a conventional art, there is known, in a fuel supply system for supplying a high pressure fuel to an injector through a delivery pipe from a high pressure fuel pump, a fuel supply device adapted to connect a mechanical pressure control valve to the delivery pipe. In such fuel supply device, when the fuel pressure in the delivery pipe exceeds over a predetermined pressure, the pressure control valve is opened to thereby discharge the fuel from the delivery pipe to reduce the fuel pressure in the delivery pipe to be less than the predetermined pressure.

However, in such a mechanical pressure control valve as mentioned above, in order to remove, in a short time, the fuel in the form of vapor generated in a fuel supply line, it was necessary to reduce the pressure in the delivery pipe through the fuel injection of the injector, which requires an unnecessary fuel injection for the pressure reduction.

Because of this reason, it is considered that the pressure in the delivery pipe is reduced by forcibly opening the pressure control valve. Such technology is, for example, disclosed in Japanese Laid-open patent (KOKAI) Publication No. HEI 10-054318 concerning a double system of fuel injection type internal combustion engine.

In this publication, there is disclosed a fuel injection type internal combustion engine for reducing a pressure by means of an electromagnetic high pressure regulator (relief valve), which is to be opened by an input signal at a time of requiring a pressure reduction in the delivery pipe or for avoiding a pressure increase in the delivery pipe.

It is also disclosed in this publication that the pressure in the delivery pipe can be promptly made to a reduced pressure state from the high pressure state at a time of requiring no fuel injection such as at a shift-up time of a vehicle mounted with an automatic speed-variable transmission or at an accelerator pedal releasing time.

However, such fuel injection type internal combustion engine is an engine in which the fuel in the delivery pipe is discharged for reducing the fuel pressure, and accordingly, it may be said to be related to a single system fuel injection type internal combustion engine equipped only with either one of the direct injection injector and port fuel injection injector. In this meaning, the above prior art publication does not consider the characteristics of a double system of fuel injection equipped with both the direct injection injector and the port fuel injection injector.

Here, if the structure in which valve portion in such conventional fuel injection type internal combustion engine is driven by the electromagnetic drive is applied as it is to the direct fuel injection injector of the double system of the fuel injection, there may cause a problem at a time when the fuel injected from the port fuel injection injector is fully (100%) used, and on the other hand, the fuel injected from the direct injection injector is not (0%) used (that is, in a state that the direct injection injector is not operated). For example, in an event that the fuel stays without being injected in the direct injection delivery pipe for supplying the fuel in the direct injection injector, the fuel is apt to be highly pressurized and highly heated through the heat transfer from the internal combustion engine. At this time, although the pressure in the delivery pipe may be reduced by the operation of the relief valve, the fuel expands because of the heat increase and the fuel density becomes lower, and if such a low density fuel is injected from the direct injection injector, there is a fear of injection of lean mixed fuel.

SUMMARY OF THE INVENTION

An object of the present invention is therefore to substantially eliminate defects or drawbacks encountered in the prior art mentioned above and to provide a double system of fuel injection type internal combustion engine capable of always ensuring an optimum pressure and temperature of a fuel in a direct injection injector and improving air/fuel mixture performance at the time of fuel injection through the direct injection injector.

This and other objects can be achieved according to the present invention by providing a double system of fuel injection type internal combustion engine comprising:

a direct injection injector;

a port fuel injection injector;

a control unit for changing an fuel injection distribution ratio of fuels injected from the direct injection injector and port fuel injection injector in accordance with an operating condition of the engine;

a delivery pipe connected to the direct injection injector so as to supply the fuel to the direct injection injector;

a high pressure fuel pump for supplying the fuel under pressure to the direct injection injector through the delivery pipe;

a fuel pressure sensor for detecting a fuel pressure in the delivery pipe;

a fuel temperature sensor for detecting a fuel temperature in the delivery pipe; and a fuel regulating unit for regulating the fuel pressure and fuel temperature in the delivery pipe, wherein at a time when the fuel injection distribution ratio of the port fuel injection injector is higher than that of the direct injection injector and at least one of the fuel pressure value and fuel temperature value detected respectively by the fuel pressure sensor and the fuel temperature sensor exceeds over an aimed value, the control unit controls the fuel regulating unit so as to lower the exceeding value thereof.

In a preferred embodiment of the above aspect of the present invention, the control unit will judge that the port fuel injection injector has the fuel injection distribution ratio higher than that of the direct injection injector and control the fuel regulating unit at a time when the fuel injection distribution ratio of the port fuel injection injector is of 100% or near.

The fuel regulating unit may be incorporated with a first flow control valve disposed to a fuel supply line for supplying the fuel in a fuel tank of the engine to the delivery pipe of the direct injection injector and a second flow control valve disposed to a fuel return line for returning the fuel from the direct injection delivery pipe to the fuel tank.

The high pressure fuel pump may be operated in an event of the fuel injection distribution ratio of 100% of the port fuel injection injector, in which the first flow control valve is operated so as to stop the fuel supply to the direct injection delivery pipe, and on the other hand, when either one of the fuel pressure or the fuel temperature in the direct injection delivery pipe exceeds over the aimed value, the second flow control valve is operated as well as the first flow control valve so as to circulate the fuel in the direct injection delivery pipe.

It is desired that the second flow control valve is an electromagnetic relief valve.

According to the above characters of the present invention, the control units control the fuel regulation unit so as to lower the fuel pressure value and/or fuel temperature value at a time when the fuel injection distribution ratio of the port fuel injection injector is higher than that of the direct injection injector and at least one of the fuel pressure value and fuel temperature value detected respectively by the fuel pressure sensor and the fuel temperature sensor exceeds over an aimed value. Accordingly, at the time when the fuel is mainly injected from the port fuel injection injector, the fuel staying in the direct injection delivery pipe is heated by the heat from the internal combustion engine, and when the detected fuel pressure exceeds over the aimed value, the fuel will leak through the injection port of the direct injection injector or through the seal portion to the delivery pipe, and on the other hand, when the detected fuel temperature exceeds over the aimed value, the fuel expands and the fuel density is excessively lowered, so that the fuel regulating unit serves to lower the fuel pressure and/or fuel temperature to the steady and stable state. Thus, the fuel pressure and the fuel temperature in the direct injection delivery pipe can be always ensured to be steady and stable, thus improving the air/fuel mixture performance at the injection time of the direct injection injector.

According to the preferred embodiment, the control unit controls the fuel regulating unit at a time when the fuel injection distribution ratio of the port fuel injection injector is of 100% or near. Accordingly, in the case where the fuel is mainly injected through the port fuel injection injector and is less injected through the direct injection injector, the control unit controls the fuel regulation unit. Thus, for example, an event such that the fuel stays in the direct injection delivery pipe and is highly pressurized and highly heated therein can be avoided.

Moreover, in another preferred embodiment in which the flow regulating unit is incorporated with a first and second flow control valve. The fuel staying in the direct injection delivery pipe can be prevented from being highly pressurized and heated by the heat transfer from the internal combustion engine by opening the first and second flow control valves to circulate the fuel in the direct injection delivery pipe. Accordingly, the fuel in the direct injection delivery pipe can be always maintained at appropriate pressure and temperature.

Furthermore, in still another preferred embodiment, in an event of the fuel injection distribution ratio of 100% of the port fuel injection injector, the first flow control valve is operated so as to stop the fuel supply to the direct injection delivery pipe, and on the other hand, when either one of the fuel pressure or the fuel temperature in the direct injection delivery pipe exceeds over the aimed value, the second flow control valve is operated. Therefore, in an event of the fuel injection distribution ratio of 100% of the port fuel injection injector, the first flow control value is closed so as to stop circulation of the fuel in the direct injection delivery pipe. In an event that either one of fuel pressure or fuel temperature exceeds over the aimed value, the fuel in the direct injection delivery pipe circulates so that fresh fuel flows into there. Accordingly, the fuel can be always surely maintained in the direct injection delivery pipe to be stable and steady.

In addition, in another preferred embodiment, an electromagnetic relief valve may be utilized as the second flow control valve. Accordingly, in comparison with a mechanical relief valve, the electromagnetic relief valve can be easily opened or closed precisely. Then, in the opened state of the electromagnetic relief valve, the highly pressurized and heated fuel in the direct injection delivery pipe is discharged and in the closed state, the fresh stable fuel is introduced into the direct injection delivery pipe and then stays therein.

Moreover, when such electromagnetic relief valve is subjected to the open/close control by a PWM (Pulse Width Modulation) controlling, the duty ratio is regulated and the flow amount of the fuel due to the repeated open/close operation of the electromagnetic relief valve is made equal to the flow amount of the fuel in the half-opened state between fully opened state and fully closed state. Therefore, the fuel amount in the direct injection delivery pipe can be finely adjusted.

DESCRIPTION OF THE PREFERRED EMBODIMENT

Figure 1:
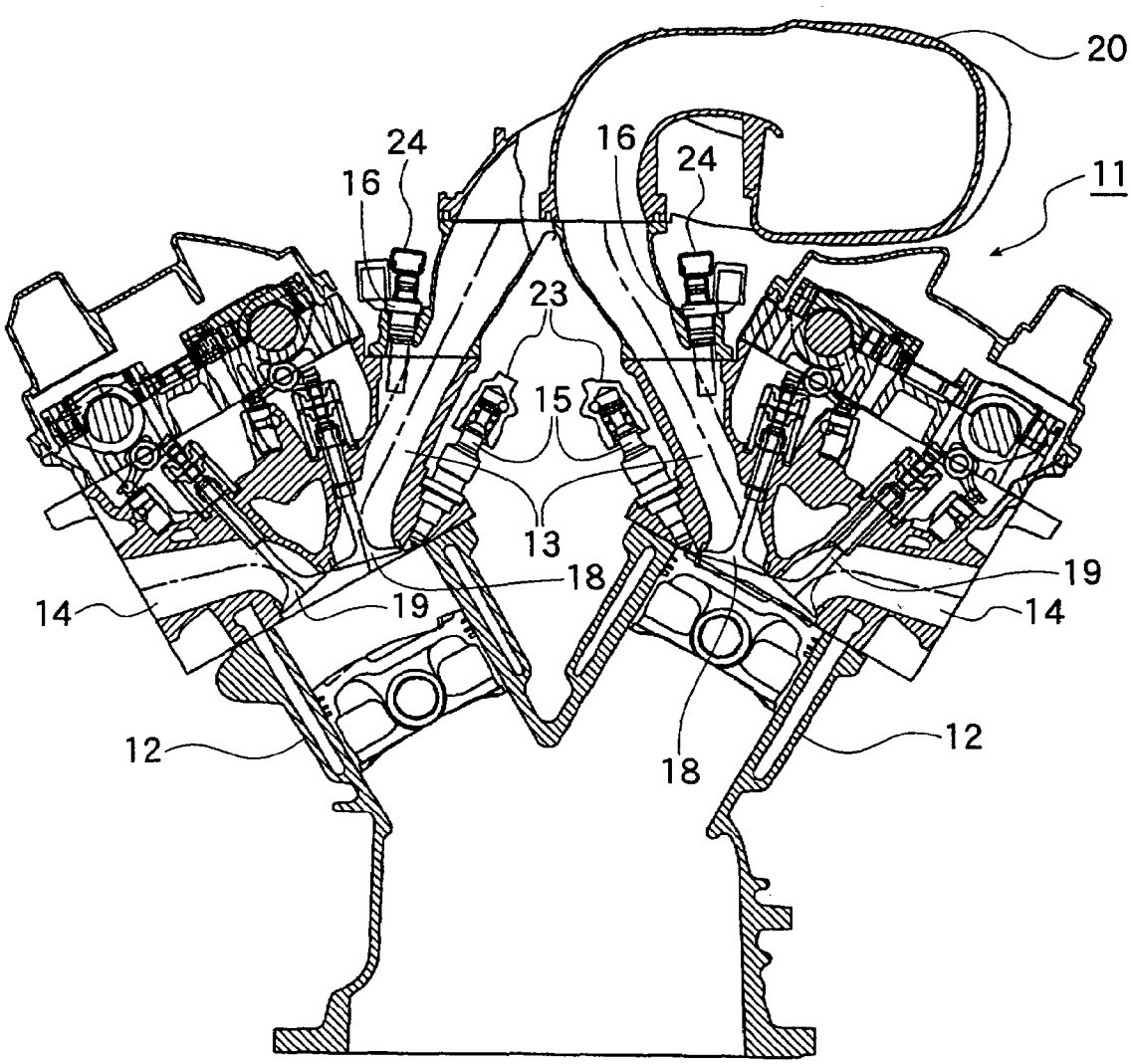
FIG. 1 is a sectional view of an internal combustion engine according to one embodiment of the present invention.
Figure 2:
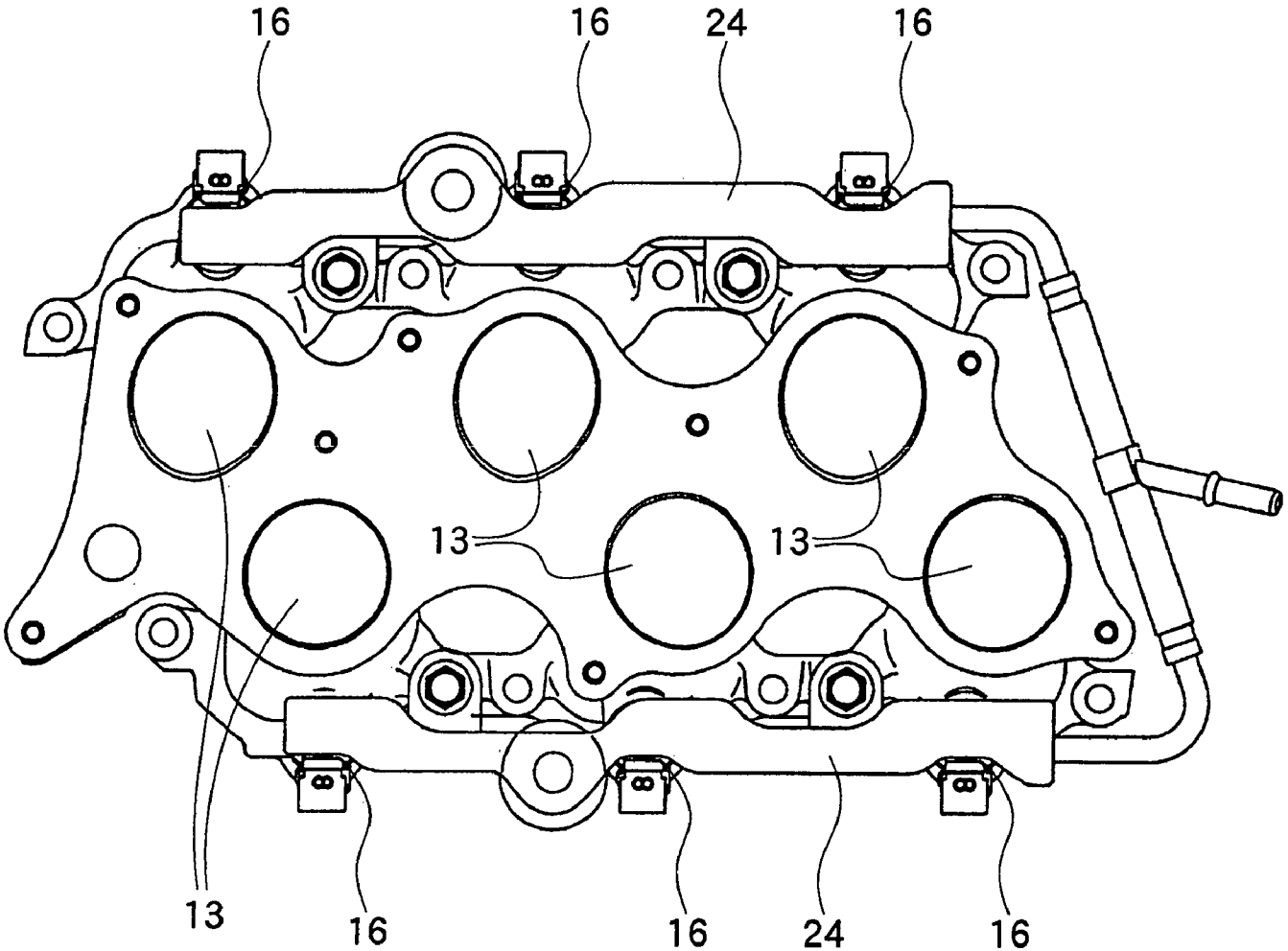
FIG. 2 is a plan view of a block diagram in which PFI injectors are arranged according to the embodiment of FIG. 1.
Figure 3:
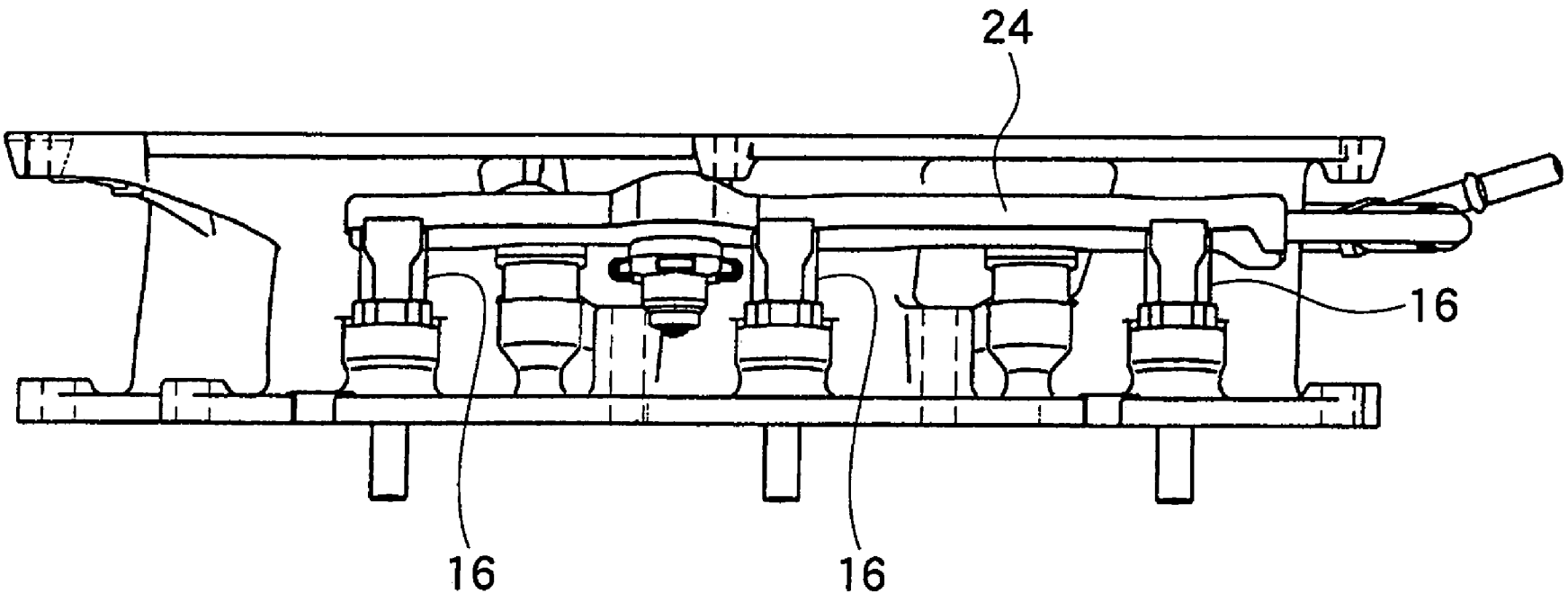
FIG. 3 is a front view of FIG. 2.

One preferred embodiment according to the present invention will be described hereunder.

With reference to FIGS. 1 to 6, reference numeral 11 denotes a 6-cylinder engine as a double system of fuel injection type internal combustion engine (which may be called hereinlater merely "engine") of the present invention, in which an intake port 13 and an exhaust port 14 are connected to each of the cylinders 12, which is in addition provided with a direct injection-type injector (DI injector) 15 and a port fuel injection-type injector (PFI injector) 16.

The fuel is directly injected into the cylinder, i.e., combustion chamber, 12 from the DI injector 15 and is then mixed with air in the cylinder 12, and in addition, the fuel is injected into the intake port 13 through the PFI injector 16 and is then mixed with air passing in the intake port 13. The thus mixed fuel is sucked in the cylinder 12 and burnt therein by an ignition of an ignition plug, not shown, at a predetermined timing.

Further, each of the cylinders 12 is also provided with an intake valve 18 for opening or closing the intake port and an exhaust valve 19 for opening or closing the exhaust port, and by opening the intake valve 18, a clean air is introduced into the cylinder 12, i.e. combustion chamber, from a serge tank 20 through the intake port 13.

As shown in FIGS. 1 to 4, the respective DI injectors 15 arranged for the respective cylinders 12 are coupled with each other through direct injection delivery pipes (DI delivery pipes) 23, and the respective PFI injectors 16 are also coupled with each other through port fuel injection delivery pipes (PFI delivery pipes) 24. The DI delivery pipes 23 are connected through a direct injection conduit (DI conduit) 26 so that the injected fuel circulates to a fuel tank 28, and the PFI delivery pipes 24 are connected to the fuel tank 28 through an intake pipe injection conduit (PFI conduit) 27.

Figure 4:
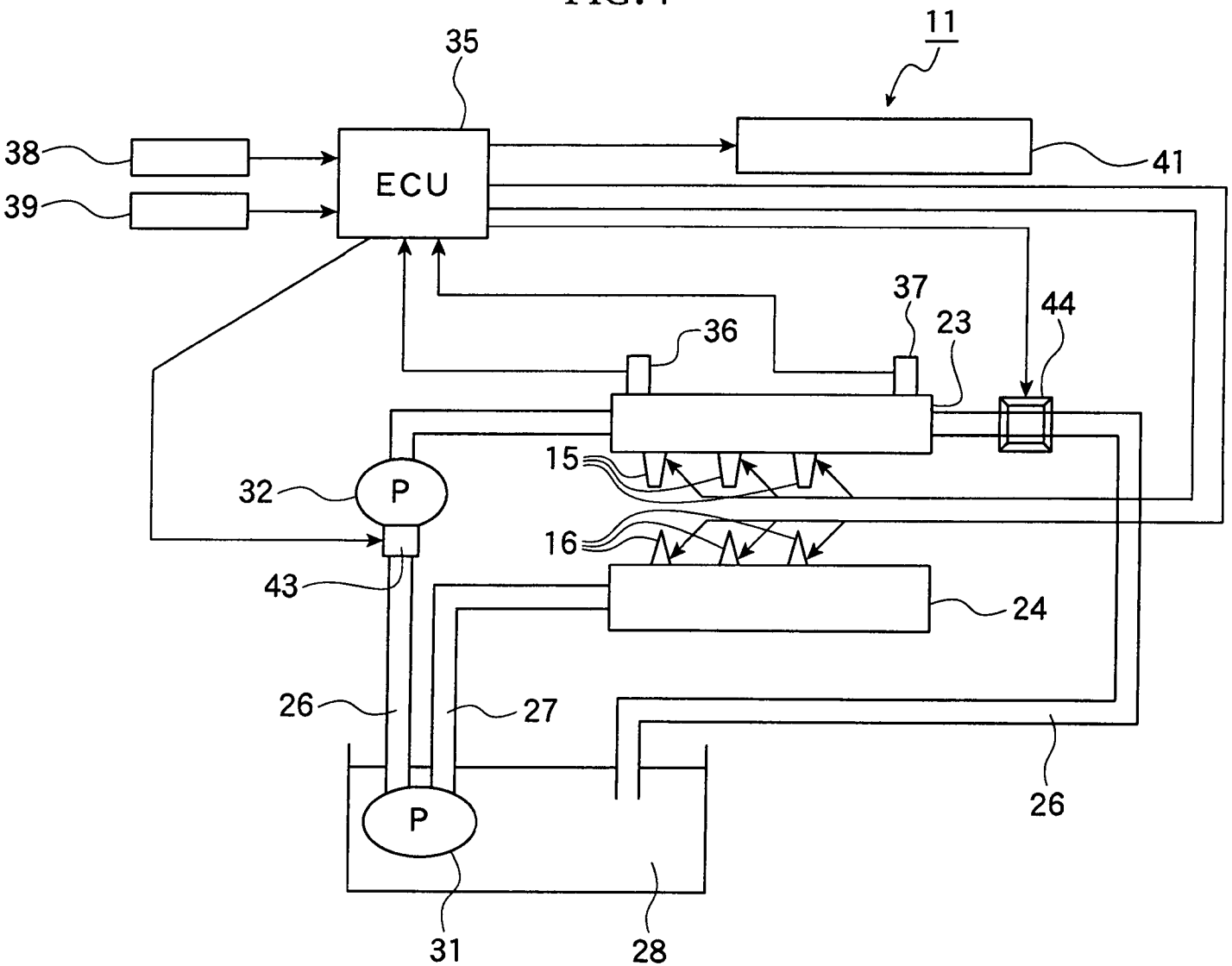
FIG. 4 is a block diagram for explaining a fuel flow controlling of the internal combustion engine of this embodiment.

As shown in FIG. 4, the fuel is delivered, at a predetermined high pressure, to the DI delivery pipe 23 by means of a fuel pump 31 and a high pressure pump 32, and the fuel is also delivered, at a pressure lower than that of the DI delivery pipe side, to the PFI delivery pipe 24 by means of the fuel pump 31. For the DI injector 15, in order to directly inject the fuel in the highly pressurized cylinder 12, a high pressure is required.

These injectors 15 and 16 inject the fuel, at a predetermined amount, delivered at the predetermined fuel pressure by the fuel pumps 31 and 32 by valves, not shown, by a predetermined injecting time period.

These injectors 15 and 16 are connected to an engine control unit (ECU) 35 as control means so as to control opening (or closing) timing and opening (or closing) time interval of the valves. According to this arrangement, the fuel is injected from both the injectors 15 and 16 at a fuel injection distribution (divided) ratio. The fuel injection distribution ratio of the fuel from the injectors 15 and 16 can be changed in accordance with the engine operating condition. The fuel injection distribution ratio is a ratio of fuel injected from each injector 15, 16 to the total fuel injected from both DI injector 15 and PFI injector 16. For example, if the fuel injection distribution ratio of the PFI injector 16 is 80%, the fuel injection distribution ratio of the DI injector is 20%.

A fuel pressure sensor 36 arranged to the DI delivery pipe 23 as fuel pressure detection means and a fuel temperature sensor 37 arranged thereto as fuel temperature detection means are connected to the ECU 35. An engine revolution speed (number) sensor 38 for detecting the revolution of six-cylinder engine and an engine load sensor 39 for detecting the engine load are also connected to the ECU 35. According to this arrangement, the fuel pressure in the DI delivery pipe 23 is detected by the fuel pressure sensor 36, and the fuel temperature therein is detected by the fuel temperature sensor 37. The operating condition of the engine, i.e. six-cylinder engine, is also detected by the engine revolution sensor 38 and the engine load sensor 39.

As the engine load sensor 39, a sensor for detecting intake air amount will be utilized, and in an alternation, a sensor for detecting an accelerator opening or a sensor for detecting an intake negative pressure may be utilized.

Various kinds of actuators 41 may be incorporated for the ECU 35 so as to be controlled or regulated by signals from the ECU 35.

A high pressure fuel pump flow (flow rate) control valve 43 (first flow control valve) as fuel adjusting means is disposed on the inlet side of the DI delivery pipe 23 in the DI conduit 26 as a fuel feed line from the fuel tank 28 to the DI delivery pipe 23. On the other hand, an electromagnetic relief valve 44 (second flow control valve) as fuel adjusting means is disposed on the outlet side of the DI delivery pipe 23 in the DI conduit 26 as a fuel return line for returning the fuel in the DI delivery pipe 23 to the fuel tank 28.

The ECU 35 hence operates to change the fuel pressure in accordance with the engine operating condition and control the fuel injection amount as well.

The six-cylinder engine 11 of this embodiment will operate in the following manner.

Figure 5:
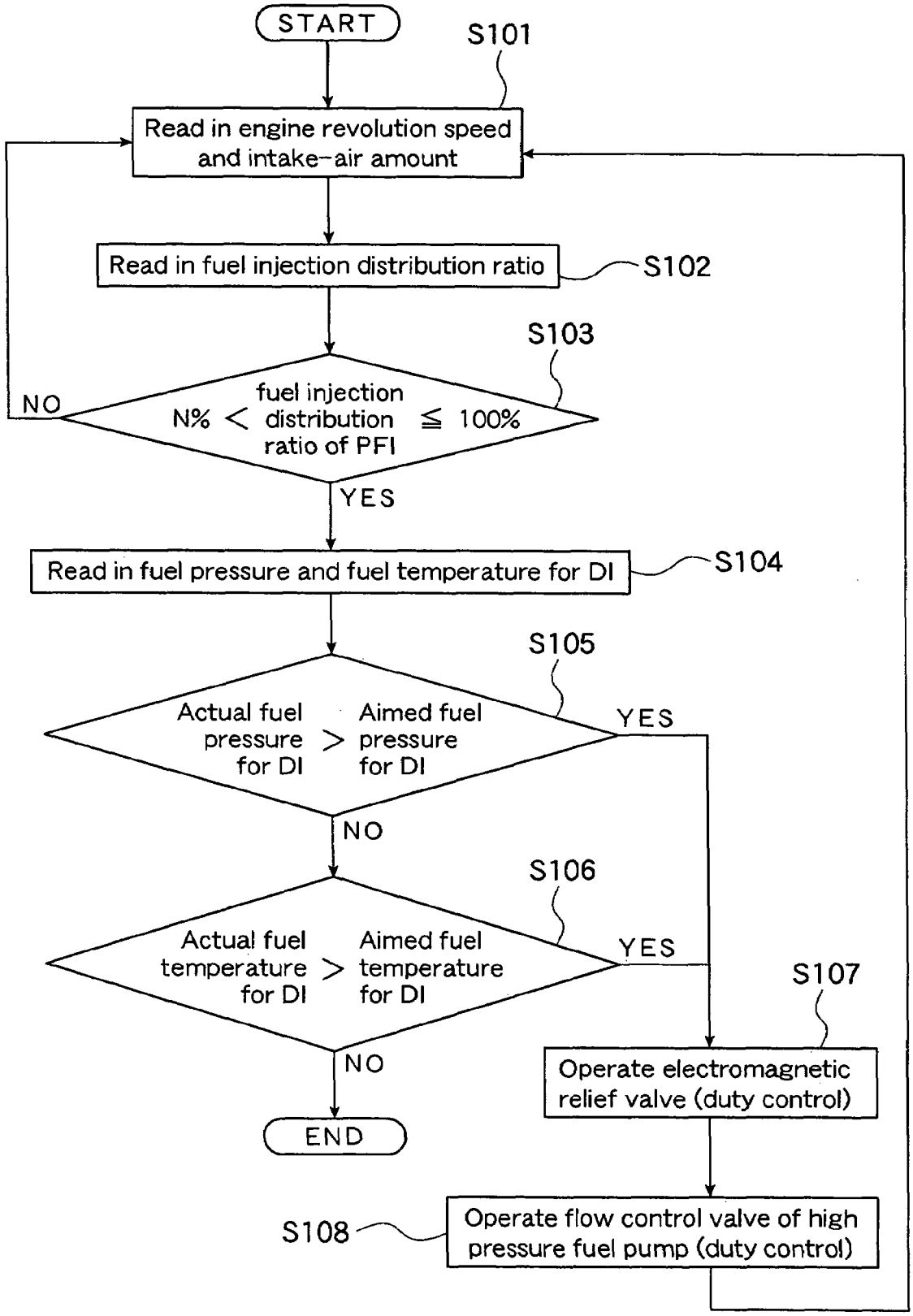
FIG. 5 is a flowchart representing a controlling of a flow control valve of a high pressure fuel pump and an electromagnetic relief valve by an engine control unit (ECU) according to the above embodiment.

FIG. 4 is a block diagram showing the fuel feed or supply line in the six-cylinder engine, and FIG. 5 is a flowchart representing the controlling of the high pressure fuel pump flow control valve 43 and electromagnetic relief valve 44.

With reference to FIGS. 4 and 5, the ECU 35 reads in detection data detected by the engine revolution sensor 38 and the engine load sensor 39 in connection with the engine revolution speed and engine intake air amount, respectively (step S101).

Next, the ECU 35 reads in the fuel injection distribution ratio of the DI injector 15 and the PFI injector 16 (step S102) after calculates them. Although the high pressure fuel pump 32 is operated at both the fuel injection distribution ratio of the PFI injector 16 of 100% and less, the high pressure fuel pump 32 operates, at the fuel injection distribution ratio of 100%, such that the flow control valve 43 of the high pressure fuel pump is closed so as to stop the fuel supply to the DI delivery pipe 23.

The ECU 35 also serves to judge whether the fuel injection distribution ratio of the PFI injector 16 is within a preliminarily predetermined range from N % to 100% (step S103). In the described embodiment, in the case of N=80%, for example, the ECU 35 judges that the fuel injection distribution ratio of the PFI injector 16 is high. On the other hand, in the case of "NO" in the judgment, the operation returns to the step S101, and in the case of "YES" in the judgment, the fuel pressure for the DI detected by the fuel pressure sensor 36 and the fuel temperature for the DI detected by the fuel temperature sensor 37 are read in (step S104).

Then, the ECU 35 judges whether an actual pressure of the fuel staying in the DI delivery pipe 23 is larger than an aimed fuel pressure for DI (step S105). In this judgment, in the case of "YES", the electromagnetic relief valve 44 is operated to be opened by the PWM (Pulse Width Modulation) control through the regulation of the duty ratio in response to the degree of the fuel pressure (step S107), and moreover, the flow rate control valve 43 of the high pressure fuel pump 32 is operated to be opened by the PWM control through the regulation of the duty ratio (step S108) to thereby circulate the fuel in the DI delivery pipe 23 and flow in the fuel in the steady condition to thereby return the step S101. On the contrary, in the case of "NO" in this judgment, it is judged whether the actual fuel temperature is larger than an aimed fuel temperature for the DI (step S106).

Thus, the ECU 35 judges whether the actual temperature of the fuel staying in the DI delivery pipe 23 is higher than the aimed fuel temperature for the DI (step S 106). In this judgment, in the case of "YES", the step returns to the step S101 through the steps S107 and S108, and on the contrary, in the case of "NO", the controlling process is ended.

That is, the ECU 35 serves to open the high pressure fuel pump flow (rate) control valve 43 and the electromagnetic relief valve 44 (steps S107 and S108) and then to circulate the fuel in the case where the port fuel injection injector 16 has a high fuel injection distribution ratio ("YES" in the step S103) and either one of the fuel pressure detected by the fuel pressure sensor 36 and the fuel temperature detected by the fuel temperature sensor 37 exceeds over the aimed value ("YES" in the step S105 and "YES" in the step S106).

The open/close control of the electromagnetic relief valve 44 is performed by the PWM control to thereby finely adjust stepwise the degree of opening of the electromagnetic relief valve 44.

Further, in the manner such that the electromagnetic relief valve 44 is controlled to be opened or closed through the PWM control so that opening amount of the electromagnetic relief valve 44 is finely adjusted in a phased manner.

Figure 6A:
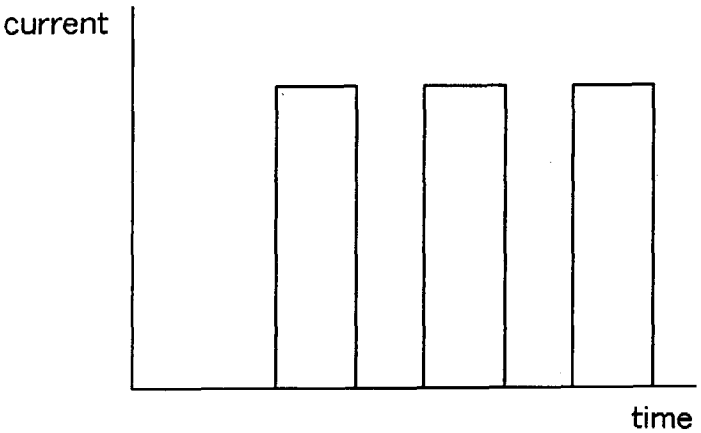
FIGS. 6A-6D are graphs showing a condition for PWM control to DI delivery pipe according to the embodiment.
Figure 6B:
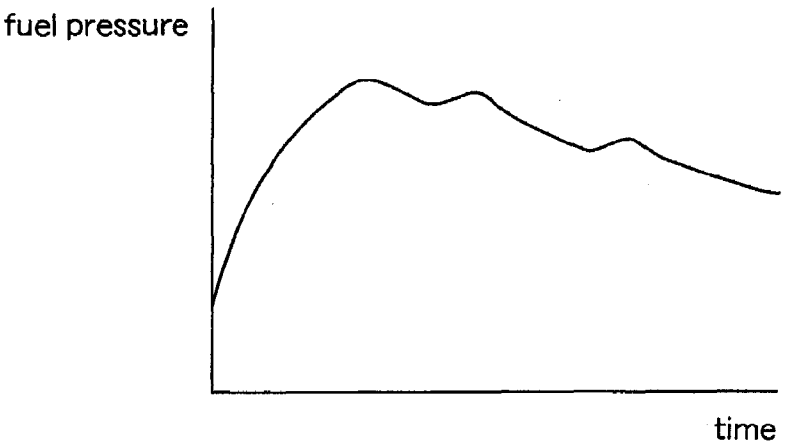
Figure 6C:
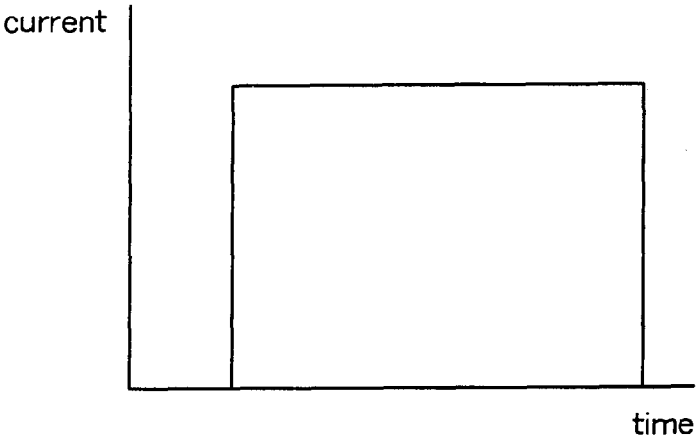
Figure 6D:
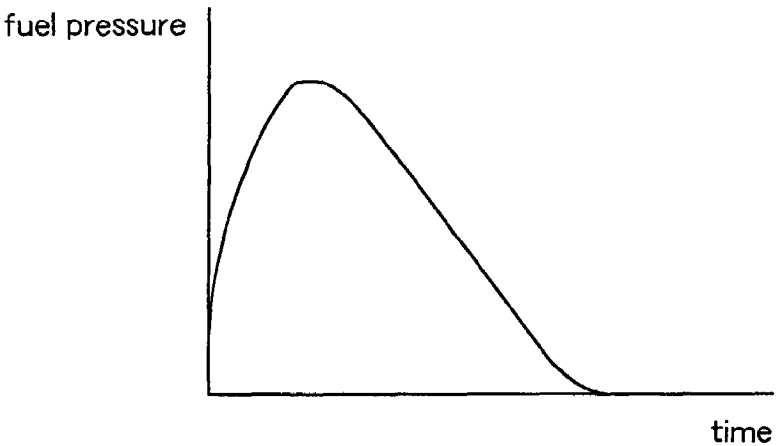

For example, as shown in FIG. 6A, when opening or closing of the electromagnetic relief valve 44 is controlled by PWM control and by conducting a current of the duty ratio of 50%, the fuel in the DI delivery pipe 23 is gently guided to the DI conduit 26 so as not to rapidly lower the fuel pressure in the DI delivery pipe 23 as shown in FIG. 6B. On the contrary, in the case where the electromagnetic relief valve 44 is subjected to the PWM control and a current passes as shown in FIG. 6C, the fuel pressure is rapidly lowered as shown in FIG. 6D.

According to the six-cylinder engine 11 of the characters mentioned above, in the case where the fuel injection distribution ratio of the port fuel injection injector 16 is high (high value) and the fuel pressure detected by the fuel pressure sensor 36 and the fuel temperature detected by the fuel temperature sensor 37 are high (high values), the ECU 35 serves to operate the electromagnetic relief valve 44 to lower these values. Because of this reason, in the case where the fuel is injected through the PFI injector 16, the fuel staying in the DI delivery pipe 23 is heated by the heat transferred from the six-cylinder engine 11 and the fuel pressure detected by the fuel pressure sensor 36 becomes higher than the aimed value of the fuel pressure. In such a case, the fuel may leak through the injection port of the DI injector 15 and the sealed portion to the DI delivery pipe 23. When the fuel temperature detected by the fuel temperature sensor 37 becomes higher than the aimed value of the fuel temperature, the fuel expands and the fuel density will become excessively lowered. Then, the electromagnetic relief valve 44 operates to make the high fuel pressure and high fuel temperature stable and steady, and the fuel returns to the fuel tank 28 so as to be again usable in the steady state. Thus, according to the present embodiment, the fuel can be always maintained at its suitable pressure and temperature in the DI delivery pipe 23 and the air/fuel mixture performance at the fuel injection time in the DI system can be hence improved.

Furthermore, the ECU 35 serves to control the electromagnetic relief valve 44 in the case where the fuel injection distribution ratio of the PFI injector 16 is 100% or near. Thus, the fuel is mainly injected through the PFI injector 16 and is substantially less injected through the DI injector 15, the ECU 35 controls the electromagnetic relief valve 44. Therefore, for example, the ECU 35 serves to prevent the fuel from staying in the DI delivery pipe 23 and from being highly pressurized and highly heated therein in the case where the PFI injector 16 is mainly driven and the DI injector is substantially not driven.

Moreover, the six-cylinder engine 11 of the present embodiment is provided with the high pressure fuel pump flow rate control valve 43 and the electromagnetic relief valve 44. Accordingly, it can be possible to prevent the fuel staying in the DI delivery pipe 23 from being highly pressurized and highly heated by the heat transfer from the six-cylinder engine 11 by circulating the fuel in the DI delivery pipe 23 by opening the high pressure fuel pump flow rate control valve 43 and the electromagnetic relief valve 44. Thus, the fuel can be always kept in the Dl delivery pipe 23 at the suitable pressure and temperature.

In addition, the ECU 35 serves to operate the flow rate control valve 43 of the high pressure fuel pump 32 so as to stop the supply of the fuel to the DI delivery pipe 23 at the fuel injection distribution ratio of 100% of the PFI injector 16, and also serves to operate the electromagnetic relief valve 44 so as to circulate the fuel in the DI delivery pipe 23 at the time when at least one of the fuel pressure and the fuel temperature in the DI delivery pipe 23 exceeds over the aimed value. Because of this reason, at the time when the fuel injection distribution ratio of 100% of the PFI injector 16, the high pressure fuel pump flow rate control valve 43 is closed to thereby stop the circulation of the fuel in the DI delivery pipe 23, and on the other hand, at the time when either one of the fuel pressure and the fuel temperature exceeds over the aimed value, the fuel in the DI delivery pipe 23 circulates and fresh fuel is introduced, thus always ensuring the fuel in the steady and stable state.

Further, the open/close operation of the electromagnetic relief valve 44 is apt to be carried out more easily than in the use of a mechanical relief valve, and accordingly, in the opened state of the electromagnetic relief valve 44, the fuel highly pressurized and heated in the DI delivery pipe 23 is released, and in the closed state thereof, the fresh fuel in the steady state is introduced into the DI delivery pipe 23 and stays there.

When the open/close control of the electromagnetic relief valve 44 is performed through the PWM control, the flow rate of the fuel in the repeated open/close control thereof can be made equal to the fuel flow rate in the half-opened state between the full opened and full closed states. Therefore, the fuel amount in the DI delivery pipe 23 can be finely regulated, and the fuel can be returned little by little to the fuel tank 28.

For example, although in the described embodiment of the internal combustion engine, one DI injector 15 and one PFI injector 16 are provided for each cylinder 12, the present invention is not limited to this embodiment and may provide a modification in which one DI injector 15 is provided for each cylinder 12, a plurality of cylinders are connected to one intake pipe to supply air thereto, and one PFI injector 16 is connected to this intake pipe to thereby introduce the air/fuel mixture injected from the one PFI injector 15 to the cylinders 12, respectively.

What is claimed is:

1. A double system of fuel injection type internal combustion engine comprising:

a direct injection injector;

a port fuel injection injector;

a control unit for changing an fuel injection distribution ratio of fuels injected from the direct injection injector and port fuel injection injector in accordance with an operating condition of the engine;

a delivery pipe connected to the direct injection injector so as to supply the fuel to the direct injection injector;

a high pressure fuel pump for supplying the fuel under pressure to the direct injection injector through the delivery pipe;

a fuel pressure sensor for detecting a fuel pressure in the delivery pipe;

a fuel temperature sensor for detecting a fuel temperature in the delivery pipe; and a fuel regulating unit for regulating the fuel pressure and fuel temperature in the delivery pipe, wherein at a time when the fuel injection distribution ratio of the port fuel injection injector is higher than that of the direct injection injector and at least one of the fuel pressure value and fuel temperature value detected respectively by the fuel pressure sensor and the fuel temperature sensor exceeds over an aimed value, the control unit controls the fuel regulating unit so as to lower the exceeding value thereof.

2. The double system of fuel injection type internal combustion engine according to claim 1, wherein the control unit judges that the port fuel injection injector has the fuel injection distribution ratio higher than that of the direct injection injector and controls the fuel regulating unit at a time when the fuel injection distribution ratio of the port fuel injection injector is of 100% or near.

3. The double system of fuel injection type internal combustion engine according to claim 1, wherein the fuel regulating unit is incorporated with a first flow control valve disposed to a fuel supply line for supplying the fuel in a fuel tank of the engine to the delivery pipe of the direct injection injector and a second flow control valve disposed to a fuel return line for returning the fuel from the direct injection delivery pipe to the fuel tank.

4. The double system of fuel injection type internal combustion engine according to claim 3, wherein the high pressure fuel pump is operated in an event of the fuel injection distribution ratio of 100% of the port fuel injection injector, in which the first flow control valve is operated so as to stop the fuel supply to the direct injection delivery pipe, and on the other hand, when either one of the fuel pressure or the fuel temperature in the direct injection delivery pipe exceeds over the aimed value, the second flow control valve is operated as well as the first flow control valve so as to circulate the fuel in the direct injection delivery pipe.

5. The double system of fuel injection type internal combustion engine according to claim 3, wherein the second flow control valve is an electromagnetic relief valve.

* * * * *

UNITED STATES PATENT AND TRADEMARK OFFICE

CERTIFICATE OF CORRECTION

PATENT NO. : 7,281,517 B2
APPLICATION NO. : 11/378922
DATED : October 16, 2007
INVENTOR(S) : Miyazaki et al.

It is certified that error appears in the above-identified patent and that said Letters Patent is hereby corrected as shown below:

At Column 6, line 30, delete "N %" and insert -- N% --, therefore.

At Column 6, line 57, delete "S 106)." and insert -- S106). --, therefore.

At Column 8, line 1, delete "D1" and insert -- DI --, therefore.

At Column 8, line 51, in Claim 1, delete "an" and insert -- a --, therefore.

Signed and Sealed this

Twentieth Day of May, 2008

JON W. DUDAS
*Director of the United States Patent and Trademark Office*